United States Patent [19]

Desgouilles

[11] 4,278,724

[45] Jul. 14, 1981

[54] COMPOSITE BITUMINOUS SHEET, PARTICULARLY FOR SEALING MEMBERS

[75] Inventor: Henri F. M. Desgouilles, Chantilly, France

[73] Assignee: Composants Industrialises du Batiment, par abreviation C.I.B., Paris, France

[21] Appl. No.: 100,963

[22] Filed: Dec. 6, 1979

[30] Foreign Application Priority Data

Dec. 7, 1978 [FR] France ..... 78 34495

[51] Int. Cl.[3] ..... B32B 11/08; B32B 11/10

[52] U.S. Cl. ..... 428/193; 428/192; 428/219; 428/230; 428/251; 428/252; 428/253; 428/489

[58] Field of Search ..... 428/121, 192, 193, 230, 428/231, 245, 251, 252, 253, 489, 68, 222, 224, 219

[56] References Cited

U.S. PATENT DOCUMENTS

| | | | |
|---|---|---|---|
| 2,481,370 | 9/1949 | Berge | 428/489 |
| 3,813,280 | 5/1974 | Olszyk et al. | 428/489 |
| 4,035,544 | 7/1977 | Iwasoki et al. | 428/489 |

FOREIGN PATENT DOCUMENTS

| | | | |
|---|---|---|---|
| 2228980 | 1/1974 | Fed. Rep. of Germany | 428/489 |
| 1323793 | 3/1963 | France | 428/230 |

*Primary Examiner*—James J. Bell

*Attorney, Agent, or Firm*—Young & Thompson

[57] ABSTRACT

This invention relates to a composite bituminous sheet, particularly useful for sealing members.

Said sheet consists of a main or external zone (1) formed of a cloth which is substantially non-extensible under low stress surrounding at least one central zone (2) to which it is bound, which is formed of an extensible elastic cloth having a tensile elongation at break of at least 100%, the central and external zones being coated with the same bituminous composition having a high elongation at break and a softening point at least equal to 100° C. when determined according to the standard Ring and Ball test.

11 Claims, 6 Drawing Figures

COMPOSITE BITUMINOUS SHEET, PARTICULARLY FOR SEALING MEMBERS

This invention relates to a composite bituminous sheet, typically useful for sealing members.

In the family of the sealants provided as manufactured sheets having a thickness of a few millimeters and generally available as rolls exist many reinforcing supports coated with bituminous mixtures.

Said coated supports (based, for example, on felt board, glass cloth, glass veil, unwoven polyester, and the like) are used alone or combined by superimposition within a sealing sheet.

With most such bitumen coated reinforcing supports, the elastic properties are very low and elongation under low or high stress does not exceed about 50%.

Said sealing sheets are used on supports made of masonry, of insulating materials, etc., having generally planar surfaces or very simple geometric shapes.

There are, however, specific points, particularly at right angles with the joints of main walls, which cannot be sealed with such sheets. For example, while the linear portion of a flat expansion joint may be treated with such bituminous sheets folded in the shape of bellows, in contrast, it is impossible to achieve the sealing of angles, crossings and changes of planes.

Indeed, in the course of dimensional changes of supporting members (particularly when made of masonry) at a distance of a few cm from one another, the width of the joint formed may increase or decrease under the influence of weather conditions or due to mechanical stresses.

In the linear portion of the joint, the sealing function is insured by the variation of the geometric shape of the bellows-folded sheet in the expansion bend, and this without requiring an elongation of the sheet. At the level of angles, joint crossings, the same applies generally, but the variable geometric shape is highly complex.

To solve the latter cases, the techniques which are the most commonly used heretofore comprise producing in situ a sealing "plaster" or coating, by coating a square piece of glass cloth with a solvent-based bituminous cement, the solvent being used to fluidize the cement.

The successful nature of such a system produced on the workings is dependent on the care brought to its achievement and predominantly on the weather conditions. On the other hand, the application is not rapid, and a physical-chemical reaction is possible between the solvents of the cement and the underlying and adjacent bituminous mass of the seal, which is reflected, as time goes by, by the destruction of the sealing function of the system.

The object of this invention is to overcome the drawbacks of the prior processes and to provide a device adapted to any shapes and sizes of sealing joints and which may be achieved in a rapid ready manner by conventional means, without using any solvent.

This invention relates to a composite bituminous sheet useful, typically, for sealing members, comprising a main or external zone formed of a cloth which is substantially nonextensible under low stresses and which surrounds at least one central zone to which it is bound, which is formed by an extensible elastic cloth having a tensile elongation at break of at least 100%, the central and external zones being coated with the same bituminous composition having a high elongation at break and a softening point of at least 100° C. when determined according to the standard Ring and Ball test.

This invention relates also to the sealing members produced from said bituminous sheet.

Other characteristics and advantages of this invention will become apparent from the following description.

Thus, this invention relates to a bituminous sheet consisting of two zones each of which includes a reinforcing support of different type.

The main or external zone is formed of an inorganic- or organic-fibre cloth which is substantially non extensible under low stress, and the central zone consists of a cloth which is extensible under low stress and elastic, both zones being coated with the same bituminous binder, said binder consisting of a bituminous composition having a high elongation at break and a softening point of at least 100° C. when determined according to the standard Ring and Ball test.

By "central zone" is meant here a zone placed in the sheet in such a manner that it is completely surrounded by the external zone to which it is bound. A plurality of central zones, separated from each other, may be present in a same sheet.

As just indicated, the main or external zone is fabricated from a cloth which is substantially non-extensible under low stress; said cloth, which has a minimum weight of preferably 50 g per $m^2$, may be made of glass fibres, of polyamide fibres, or of polyester fibres, for example. It will advantageously have a tensile mechanical strength at break of at least 10 daN/cm wide lengthwise and crosswise. Its elongation under low stress should be as low as possible to give a sheet which cannot become deformed under the conditions of use at the time of its application. Its heat resistance should permit it to withstand temperatures of about 180° C. during permanent use.

On the other hand, after being coated with the bituminous composition, it will support undamaged the flame of a blow-torch.

The central zone is formed by a cloth which is elastic and extensible in all directions, which may be obtained advantageously by knitting natural fibres (such as jute, etc.) and/or chemically produced fibres, such as polyamide or polyester fibres.

Just as indicated for the cloth of the external zone, its preferred minimum weight will be of the order of 50 g/$m^2$.

Its tensile strength at break is advantageously in excess of a few daN/cm (typically of the order of 4), chiefly for reasons of production and to permit its use without any particular constraining cautionary measures.

Its tensile elongation at break is very high and should be at least equal to 100%, whatever the direction of the stress.

Its elasticity should also be high and typically, when elongated up to at least 50%, it should revert substantially instantaneously to its original condition when the stress ceases.

It may withstand relatively high thermal stresses, of the order of 180°–200° C., without loss of its elasticity.

The cloths which form the external zone and the central zone or zones are coated with the same bituminous mass having a high elongation at break and a softening point of at least 100° C. when determined according to French standard Ring and Ball test NFT 66008.

Its elongation at break will advantageously be equal to or in excess of 500%.

The flexibility in the cold of the coating bituminous mass is high and may withstand a temperature as low as −15° C. without break, when rolled up during a period of time of 5 seconds over a mandrel having a diameter of 20 mm (according to the test described in French Standard NF P 84 303).

As bituminous coating composition may be used, for example, bitumen-SBS (ternary block styrene-butadiene-styrene elastomer) mixtures and preferably BPS type mixtures.

Bitumen BPS is a bituminous composition which was disclosed in French patent application No. 78 26 336 filed by Applicant Sept. 3rd, 1978.

Said bituminous composition consists of a ternary mixture of 52–78 wt% bitumen; (b) 20–40 wt% polyolefin and (c) 2–8 wt% of a butadiene-styrene elastomer.

The bitumen is, for example, a straight run or oxidized bitumen having a penetration of 40–220; the polyolefin may be a polypropylene, a polybutylene, a propylene-ethylene copolymer or a propylene-ethylene-butylene copolymer; and the elastomer is typically a styrene-butadiene copolymer having a molecular weight between about 100,000 and about 300,000.

Said BPS composition may also contain a filler and/or a pigment and/or a fireproofing agent.

Table I below sets forth the properties desired in the composite sheet of this invention and in its different zones.

TABLE I

| Properties desired in the composite sheet | External zone (normal parts) | Central zone (specific points) |
|---|---|---|
| Tensile strength at break (of the reinforcing support) | >10 daN/cm | >4 daN/cm |
| Elongation at break (of the reinforcing support) | >2% | >50% |
| Elasticity | Optional | >10% |
| Elongation of the bituminous binder | >500% | >500% |
| Foldability in the cold, should withstand a temperature of | −15° C. | −15° C. |
| Resistance to static punching (according to NF P 84 352) | >10 kg | >10 kg |
| Weldability | Good | Good |

To produce the composite sheet of this invention it is preferred to use the following procedure.

One or more zones, which will form the central zones, are cut out of a cloth which is non-extensible under low stress.

On the other hand, pieces having a size at least equal to the pieces cut out of the first cloth are cut out of a sheet of an extensible elastic cloth.

The non-extensible cloth has been pre-coated in a conventional manner, with a coating machine or other system, with the desired bituminous composition. The separately coated pieces of extensible sheet are axially fitted over the holes provided in the coated non-extensible sheet and the members are made integral by joining them either along the edges or by overlapping, the bituminous composition serving to insure the junction between the central zone and the external zone.

It is understood that the central zone could be bound to the external zone along its edges by other known means, if desired.

To coat the extensible cloth used to form the central zone, the following procedure may be used, for example: an elongation of the order of 50% is imposed on the reinforcing support, in all directions, and the fibres are coated by spraying the bituminous composition, or by immersion in the latter at a temperature of 180°–200° C. This gives a planar bituminous sheet having a regular thickness and subsequently, in the course of the application, some dimensional shrinkage is found to occur by action of the temperature, which is favourable to the use of the material.

Sealing members of highly variable shapes may be formed and cut from the resulting composite sheet.

In the accompanying drawing, given solely for illustrative purposes,

FIGS. 1–5 represent different types of sealing members obtained from the composite sheet of this invention, and FIG. 6 illustrates such a sealing member placed at a crossing of joints.

FIG. 1 and FIG. 2 represent rectangular shaped members. In FIG. 1, the external zone is represented by reference 1 and the central zone by reference 2. In FIG. 2, is also illustrated a rectangular shaped member comprising an external zone 3 and two central zones 4.

Figure 1:
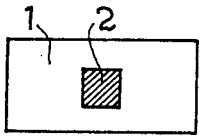
Figure 2:
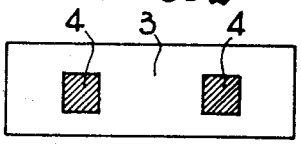
Figure 3:
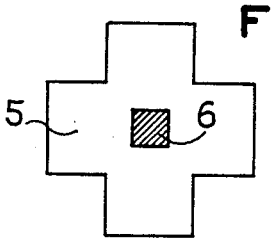
FIG. 3 illustrates a cross-shaped member in which external zone 5 surrounds a central zone 6.
Figure 4:
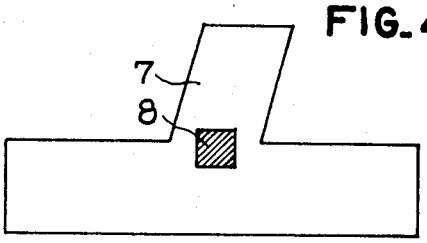
FIG. 4 illustrates a T-shaped member in which external zone 7 surrounds a central zone 8 positioned approximately at the crossing of the branches of the T.
Figure 5:
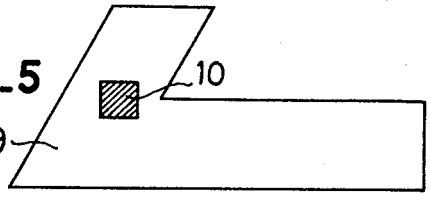

Finally, FIG. 5 illustrates an L-shaped member with an external zone 9 surrounding a central zone 10 positioned approximately at the point where the branches of the L meet.

Figure 6:
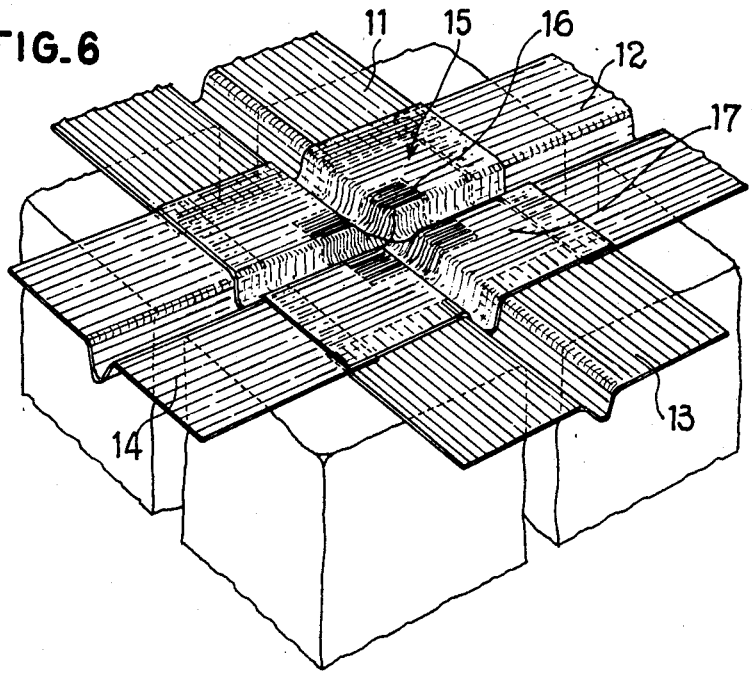

FIG. 6 illustrates the application of a square shaped sealing member of this invention to the crossing of two joints. In said Figure, the sealing sheets of the joints are represented by references 11, 12, 13 and 14 and the sealing member 15 according to this invention is applied at the crossing of the joints, over the ends of the sealing sheets, in a manner such that its central zone 16 is positioned at the crossing of both joints and may, due to its extensible nature, be closely applied on the grooves of the joints.

The edges of the external zone 17 of the sealing member are bound in a known manner to the ends of the sealing sheets of said joints.

Whatever the shape of the sealing member of this invention, the procedure used for its application is substantially the same and comprises welding with the flame of a blow-torch on the bituminous supports of the joints.

In the case of an application for the sealing at a crossing of joints as illustrated in FIG. 6, a conventional non-extensible and unshrinkable material would give an excess of material which would result in the formation of folds, whereas with the sealing members according to this invention, a mere re-heating with the flame of a blow-torch produces a slight shrinkage of the central zone of the member, with resulting disappearance of the major portion of the folds.

It is also possible to use the sealing members of this invention for the treatment of a crossing between a horizontal joint and a vertical joint, it being understood that the depth of the joints and their opening may be different and variable.

In such a case, the central zone is approximately centrally positioned at the level of the angle formed by the intersection of both planes, after which the member is welded on one side of the joint to the horizontal and vertical portions of the support, a bellows is then formed in the joint and, finally, the member is welded on the other side of the joint.

The basic importance of the possible pluridirectional elongation of the central zone becomes apparent in the course of this process: it permits the ready distortion of the member, by mere pressure, to fit the complex shape thus created in space.

The following non-limiting Example is given to illustrate this invention.

A polyamide cloth, weighing 160 g/m$^2$, is first coated with a bituminous composition of BPS type.

The resulting coated sheet has the following characteristics:

| | |
|---|---|
| Weight, per sq. meter | 4 kg |
| Thickness | 3.5 mm |
| Composition per sq. meter: | |
| . support (cloth) | 160 g |
| . BPS Composition | 3200 g |
| . white silica | 640 g |

Tensile strength and tensile elongation at break (determined according to French Standard NF G 07 001):

lengthwise: 40 daN/cm and 20% crosswise: 30 daN/cm and 20%

Static punching (according to French Standard NF P 84352): in excess of 22 kg on the perlite-based insulating panel.

Foldability in the cold (determined according to French Standard NF P 84 303) over a mandrel having a diameter of 20 mm, roll up time: 5 seconds: no cracks up to −15° C.

A knitted polyamide material is coated with the same bituminous BPS composition as described above. The resulting coated sheet has the following characteristics:

| | |
|---|---|
| Weight, per sq. meter | 3600 g |
| Thickness | 4 mm |
| Composition, per sq. meter: | |
| . support (knitted material) | 100 g |
| . BPS composition | 3500 g |

Tensile strength at break and corresponding elongation lengthwise, crosswise and diagonally: 6 daN/cm and 200%.

Static punching: in excess of 12 kg on the perlite-based insulating panel.

Foldability in the cold (determined as above): no cracks up to 31 15° C.

The BPS bituminous composition used is formulated as follows:

| | |
|---|---|
| Straight-run bitumen 80/100 | 71 wt % |
| Propylene-ethylene-butylene copolymer | 23 wt % |
| Butadiene-styrene elastomer | 6 wt % |

Having now described my invention what I claim as new and desire to secure by Letters Patent is:

1. Composite bituminous sheet, particularly useful for sealing members, comprising an external zone of a non-extensible cloth surrounding at least one central zone formed of an extensible elastic cloth, the whole being coated with a bituminous composition which is the same for all said zones.

2. Sheet as claimed in claim 1, wherein the central and external zones are welded together along their adjacent edges by means of said bituminous coating composition.

3. Sheet as claimed in claim 1, wherein the central and external zones are welded together by overlapping of their adjacent edges by means of said bituminous coating composition.

4. Sheet as claimed in claim 1, wherein the central zone is formed of a knitted material of a yarn selected from the polyamide yarns and the polyester yarns.

5. Sheet as claimed in claim 1, wherein the central zone is capable of undergoing a surface shrinkage under the effect of temperature.

6. Sheet as claimed in claim 1, wherein the external zone is formed of a cloth selected from a glass fibre cloth, a polyamide fibre cloth and a polyester fibre cloth.

7. Sheet as claimed in claim 1, wherein the cloths forming the central and external zones each have a weight of at least 50 g/m$^2$.

8. Sheet as claimed in claim 1, wherein the cloth forming the external zone has a tensile mechanical strength at break at least equal to 10 daN/cm of width, both lengthwise and crosswise.

9. Cloth as claimed in claim 1, wherein the bituminous coating composition is selected from a binary bitumen-SBS composition and a ternary bitumen-polyolefin-butadiene/styrene composition.

10. Sheet as claimed in claim 1, wherein the bituminous coating composition has an elongation at break of at least 500%.

11. Composite sealing member, comprising a composite bituminous sheet consisting of an external zone of a non-extensible cloth surrounding a central zone formed of an extensible elastic cloth, the whole being coated with a bituminous composition which is the same for all said zones.

* * * * *